US008152336B2

(12) United States Patent
Alexander et al.

(10) Patent No.: US 8,152,336 B2
(45) Date of Patent: Apr. 10, 2012

(54) REMOVABLE LED LIGHT MODULE FOR USE IN A LIGHT FIXTURE ASSEMBLY

(75) Inventors: Clayton Alexander, Westlake Village, CA (US); Brandon S. Mundell, Thousand Oaks, CA (US)

(73) Assignee: Journée Lighting, Inc., Westlake Village, CA (US)

( * ) Notice: Subject to any disclaimer, the term of this patent is extended or adjusted under 35 U.S.C. 154(b) by 502 days.

(21) Appl. No.: 12/409,409

(22) Filed: Mar. 23, 2009

(65) Prior Publication Data

US 2010/0127637 A1 May 27, 2010

Related U.S. Application Data

(60) Provisional application No. 61/116,979, filed on Nov. 21, 2008.

(51) Int. Cl.
*F21V 21/00* (2006.01)

(52) U.S. Cl. ..... 362/249.11; 362/294; 362/800; 362/147; 439/427; 439/76.1

(58) Field of Classification Search ..... 362/373, 362/294, 800, 249.11; 439/427, 76.1; 313/317, 313/318.01, 318.12
See application file for complete search history.

(56) References Cited

U.S. PATENT DOCUMENTS

| | | | |
|---|---|---|---|
| 2,430,472 | A | 11/1947 | Levy |
| D149,124 | S | 3/1948 | Hewitt |
| D152,113 | S | 12/1948 | Mehr |
| D152,115 | S | 12/1948 | Mehr |
| D191,734 | S | 11/1961 | Daher et al. |
| D217,096 | S | 4/1970 | Birns |
| 3,538,321 | A | 11/1970 | Keller et al. |
| 3,639,751 | A | 2/1972 | Pichel |
| 4,091,444 | A | 5/1978 | Mori |
| 4,453,203 | A | 6/1984 | Pate |
| 4,578,742 | A | 3/1986 | Klein et al. |
| 4,733,335 | A | 3/1988 | Serizawa et al. |
| 4,761,721 | A | 8/1988 | Willing |
| 4,872,097 | A | 10/1989 | Miller |
| D322,862 | S | 12/1991 | Miller |
| D340,514 | S | 10/1993 | Liao |
| 5,303,124 | A | 4/1994 | Wrobel |

(Continued)

FOREIGN PATENT DOCUMENTS

JP WO DM/57383 9/2001

(Continued)

OTHER PUBLICATIONS

International Search Report and Written Opinion mailed on Oct. 14, 2010 in PCT Application No. PCT/US2010/045361.

(Continued)

*Primary Examiner* — Ali Alavi
(74) *Attorney, Agent, or Firm* — Knobbe Martens Olson & Bear, LLP

(57) ABSTRACT

A removable LED light module for use in a light fixture assembly includes an LED lighting element and one or more resilient members to maintain a compression force between the LED light module and the light fixture to provide effective heat transfer from the LED light module to the light fixture. The LED light module can include a plurality of electrical contact members to facilitate an electrical connection between the LED light module and the light fixture assembly.

22 Claims, 11 Drawing Sheets

U.S. PATENT DOCUMENTS 5,337,225 A 8/1994 Brookman
5,634,822 A 6/1997 Gunell
D383,236 S 9/1997 Krogman
5,909,955 A 6/1999 Roorda
6,072,160 A 6/2000 Bahl
D437,449 S 2/2001 Soller
D437,652 S 2/2001 Uhler et al.
D443,710 S 6/2001 Chiu
D446,592 S 8/2001 Leen
D448,508 S 9/2001 Benghozi
D457,673 S 5/2002 Martinson et al.
6,441,943 B1 8/2002 Roberts et al.
D462,801 S 9/2002 Huang
D464,455 S 10/2002 Fong et al.
D465,046 S 10/2002 Layne et al.
6,478,453 B2 11/2002 Lammers et al.
D470,962 S 2/2003 Chen
D476,439 S 6/2003 O'Rourke
6,632,006 B1 10/2003 Rippel et al.
D482,476 S 11/2003 Kwong
6,682,211 B2 1/2004 English et al.
6,703,640 B1 * 3/2004 Hembree et al. ..... 257/48
6,744,693 B2 6/2004 Brockmann et al.
6,787,999 B2 9/2004 Stimac et al.
6,824,390 B2 11/2004 Brown et al.
6,864,513 B2 3/2005 Lin et al.
6,871,993 B2 3/2005 Hecht
D504,967 S 5/2005 Kung
6,902,291 B2 6/2005 Rizkin et al.
6,905,232 B2 6/2005 Lin
6,966,677 B2 11/2005 Galli
D516,229 S 2/2006 Tang
D524,975 S 7/2006 Oas
D527,119 S 8/2006 Maxik et al.
7,097,332 B2 8/2006 Vamberi
7,111,963 B2 9/2006 Zhang
7,111,971 B2 9/2006 Coushaine et al.
7,132,804 B2 11/2006 Lys et al.
7,150,553 B2 12/2006 English et al.
7,198,386 B2 4/2007 Zampini et al.
7,207,696 B1 4/2007 Lin
D541,957 S 5/2007 Wang
D544,110 S 6/2007 Hooker et al.
D545,457 S 6/2007 Chen
D564,119 S 3/2008 Metlen
7,344,279 B2 3/2008 Mueller et al.
7,344,296 B2 3/2008 Matsui et al.
7,357,534 B2 4/2008 Snyder
7,396,139 B2 7/2008 Savage
7,396,146 B2 7/2008 Wang
7,413,326 B2 8/2008 Tain et al.
D577,453 S 9/2008 Metlen
7,452,115 B2 11/2008 Alcelik
D585,588 S 1/2009 Alexander et al.
D585,589 S 1/2009 Alexander et al.
7,494,248 B2 2/2009 Li
7,540,761 B2 * 6/2009 Weber et al. ..... 439/487
7,722,227 B2 5/2010 Zhang et al.
7,740,380 B2 6/2010 Thrailkill
7,744,266 B2 6/2010 Higley et al.
D626,094 S 10/2010 Alexander et al.
7,866,850 B2 1/2011 Alexander et al.
7,874,700 B2 1/2011 Patrick
2002/0067613 A1 6/2002 Grove
2003/0185005 A1 10/2003 Sommers et al.
2004/0212991 A1 10/2004 Galli
2005/0047170 A1 3/2005 Hilburger et al.
2005/0122713 A1 6/2005 Hutchins
2005/0146884 A1 7/2005 Scheithauer
2005/0174780 A1 8/2005 Park
2006/0076672 A1 4/2006 Petroski
2006/0146531 A1 7/2006 Reo et al.
2006/0262544 A1 11/2006 Piepgras et al.
2006/0262545 A1 * 11/2006 Piepgras et al. ..... 362/373
2007/0025103 A1 2/2007 Chan
2007/0109795 A1 5/2007 Gabrius et al.
2007/0242461 A1 10/2007 Reisenauer et al.
2007/0253202 A1 11/2007 Wu et al.
2007/0279921 A1 12/2007 Alexander et al.
2007/0297177 A1 12/2007 Wang et al.
2008/0013316 A1 1/2008 Chiang
2008/0080190 A1 4/2008 Walczak et al.
2008/0084700 A1 4/2008 Van De Ven
2008/0106907 A1 5/2008 Trott et al.
2008/0130275 A1 6/2008 Higley et al.
2008/0158887 A1 7/2008 Zhu et al.
2009/0086474 A1 * 4/2009 Chou ..... 362/230
2009/0154166 A1 6/2009 Zhang et al.
2009/0213595 A1 8/2009 Alexander et al.
2010/0026158 A1 2/2010 Wu
2010/0027258 A1 2/2010 Maxik et al.
2010/0091487 A1 4/2010 Shin
2010/0091497 A1 4/2010 Chen et al.
2010/0102696 A1 4/2010 Sun
2011/0063849 A1 3/2011 Alexander et al.
2011/0096556 A1 4/2011 Alexander et al.

FOREIGN PATENT DOCUMENTS

JP 2004/265626 A 9/2004
JP 2007/273209 A 10/2007
WO WO 2004/071143 8/2004
WO WO 2007/128070 A1 11/2007
WO WO 2008/108832 9/2008

OTHER PUBLICATIONS

Non-final Office Action mailed on Sep. 7, 2010 in U.S. Application No. 11/715,271.
Allowed claims as allowed on Apr. 29, 2011 in U.S. Appl. No. 12/986,934.
Non-final Office Action mailed on Jun. 12, 2009 in Application No. 11/715,071.
PCT International Search Report and the Written Opinion mailed Jun. 23, 2008, in related PCT Application No. PCT/US2007/023110., Jun. 23, 2008.
Non-final Office Action mailed on Jun. 25, 2010, received in U.S. Appl. No. 12/149,900.
PCT International Search Report and the Written Opinion mailed Jun. 25, 2009, in related PCT Application No. PCT/US2009/035321.
International Search Report and Written Opinion as mailed on Jan. 19, 2010, received in PCT Application PCT/US09/64858.

* cited by examiner

REMOVABLE LED LIGHT MODULE FOR USE IN A LIGHT FIXTURE ASSEMBLY

CROSS-REFERENCE TO RELATED APPLICATIONS

This application claims the benefit of Provisional U.S. Patent Application No. 61/116,979 filed Nov. 21, 2008, the entire contents of which are incorporated herein by reference and should be considered a part of this specification.

BACKGROUND OF THE INVENTION

1. Field of the Invention

The present invention is directed to an LED light assembly that can be removably connected thermally and/or electrically to a light fixture assembly housing.

2. Description of the Related Art

Light fixture assemblies such as lamps, ceiling lights, and track lights are important fixtures in many homes and places of business. Such assemblies are used not only to illuminate an area, but often also to serve as a part of the decor of the area. However, it is often difficult to combine both form and function into a light fixture assembly without compromising one or the other.

Traditional light fixture assemblies typically use incandescent bulbs. Incandescent bulbs, while inexpensive, are not energy efficient, and have a poor luminous efficiency. To address the shortcomings of incandescent bulbs, a move is being made to use more energy-efficient and longer lasting sources of illumination, such as fluorescent bulbs, high-intensity discharge (HID) bulbs, and light emitting diodes (LEDs). Fluorescent bulbs and HID bulbs require a ballast to regulate the flow of power through the bulb, and thus can be difficult to incorporate into a standard light fixture assembly. Accordingly, LEDs, formerly reserved for special applications, are increasingly being considered as a light source for more conventional light fixtures assemblies.

LEDs offer a number of advantages over incandescent, fluorescent, and HID bulbs. For example, LEDs produce more light per watt than incandescent bulbs, LEDs do not change their color of illumination when dimmed, and LEDs can be constructed inside solid cases to provide increased protection and durability. LEDs also have an extremely long life span when conservatively run, sometimes over 100,000 hours, which is twice as long as the best fluorescent and HID bulbs and twenty times longer than the best incandescent bulbs. Moreover, LEDs generally fail by a gradual dimming over time, rather than abruptly burning out, as do incandescent, fluorescent, and HID bulbs. LEDs are also desirable over fluorescent bulbs due to their decreased size and lack of need of a ballast, and can be mass produced to be very small and easily mounted onto printed circuit boards.

While LEDs have various advantages over incandescent, fluorescent, and HID bulbs, the widespread adoption of LEDs has been hindered by the challenge of how to properly manage and disperse the heat that LEDs emit. The performance of an LED often depends on the ambient temperature of the operating environment, such that operating an LED in an environment having a moderately high ambient temperature can result in overheating the LED, and premature failure of the LED. Moreover, operation of an LED for extended period of time at an intensity sufficient to fully illuminate an area may also cause an LED to overheat and prematurely fail.

Accordingly, high-output LEDs require direct thermal coupling to a heat sink device in order to achieve the advertised life expectancies from LED manufacturers. This often results in the creation of a light fixture assembly that is not upgradeable or replaceable within a given light fixture. For example, LEDs are traditionally permanently coupled to a heat-dissipating fixture housing, requiring the end-user to discard the entire assembly after the end of the LED's lifespan.

Accordingly, there is a need for an improved LED light assembly that is replaceable and easily removable from engagement with the light fixture assembly.

SUMMARY OF THE INVENTION

In accordance with one embodiment, an LED light assembly removably coupleable to a light fixture assembly is provided. The LED light assembly comprises an LED lighting element and a thermal interface member coupled to the LED lighting element and configured to resiliently contact a thermally conductive housing of the light fixture assembly when the LED light assembly is installed in the light fixture assembly. The thermal interface member is configured to thermally couple the LED lighting element and the thermally conductive housing. The LED light assembly further comprises one or more resilient members operatively coupled to the thermal interface member, the resilient members configured to generate a compression force when the LED light assembly is installed in the light fixture assembly to maintain a compressive contact force between the thermal interface member and the thermally conductive housing. The LED light assembly also comprises a plurality of electrical contact members electrically connected to the LED lighting element, at least one of the electrical contact members configured to releasably contact an electrical contact on the light fixture assembly when the LED light assembly is coupled to the housing to establish an electrical connection between the LED lighting element and the housing irrespective of the orientation of the LED light assembly during installation.

In accordance with another embodiment, an LED light assembly removably coupleable to a light fixture assembly is provided. The LED light assembly comprises an LED lighting element and a thermal interface member coupled to the LED lighting element and configured to resiliently contact a thermally conductive housing of the light fixture assembly when the LED light assembly is coupled to the housing. The thermal interface member is configured to thermally couple the LED lighting element and the thermally conductive housing. The LED light assembly also comprises a plurality of resilient members operatively coupled to the thermal interface member, the resilient members movable between an uncompressed state and a compressed state when the LED light assembly is coupled to the housing to generate a compression force between the thermal interface member and the thermally conductive housing to establish a thermal connection between the LED light assembly and the housing. The LED light assembly further comprises a plurality of electrical contact members electrically connected to the LED lighting element, at least one of the electrical contact members configured to releasably contact an electrical contact on the light fixture assembly when the LED light assembly is coupled to the housing to establish an electrical connection between the LED lighting element and the housing irrespective of the orientation of the LED light assembly during installation.

In accordance with still another embodiment, a light fixture assembly is provided, comprising a thermally-conductive housing and an LED assembly removably coupleable to the thermally-conductive housing. The LED assembly comprises an LED lighting element and a thermal interface member coupled to the LED lighting element and configured to resiliently contact the thermally conductive housing when the LED light assembly is installed in the light fixture assembly to establish a thermal contact between the LED lighting element and the thermally conductive housing. The LED assembly also comprises one or more resilient members operatively coupled to the thermal interface member, the resilient members movable between an uncompressed state and a compressed state when the LED light assembly is coupled to the thermally-conductive housing to generate a compression force between the thermal interface member and the thermally conductive housing. The LED assembly further comprises a plurality of electrical contact members electrically connected to the LED lighting element and configured to releasably contact an electrical contact on the housing when the LED light assembly is coupled thereto to establish an electrical connection between the LED lighting element and the housing irrespective of the orientation of the LED light assembly during installation.

In some embodiments, the LED light assembly can have multiple sets of electrical contact members (e.g., four sets), which may be shaped as strips or pads. In certain embodiments, the electrical contact member can be gold plated or comprise other materials with high electrical conductivity.

BRIEF DESCRIPTION OF THE DRAWINGS

These and other features, aspects and advantages of the present inventions will now be described in connection with preferred embodiments, in reference to the accompanying drawings. The illustrated embodiments, however, are merely examples and are not intended to limit the inventions. The drawings include the following 13 figures

DETAILED DESCRIPTION OF THE PREFERRED EMBODIMENTS

Figure 1:
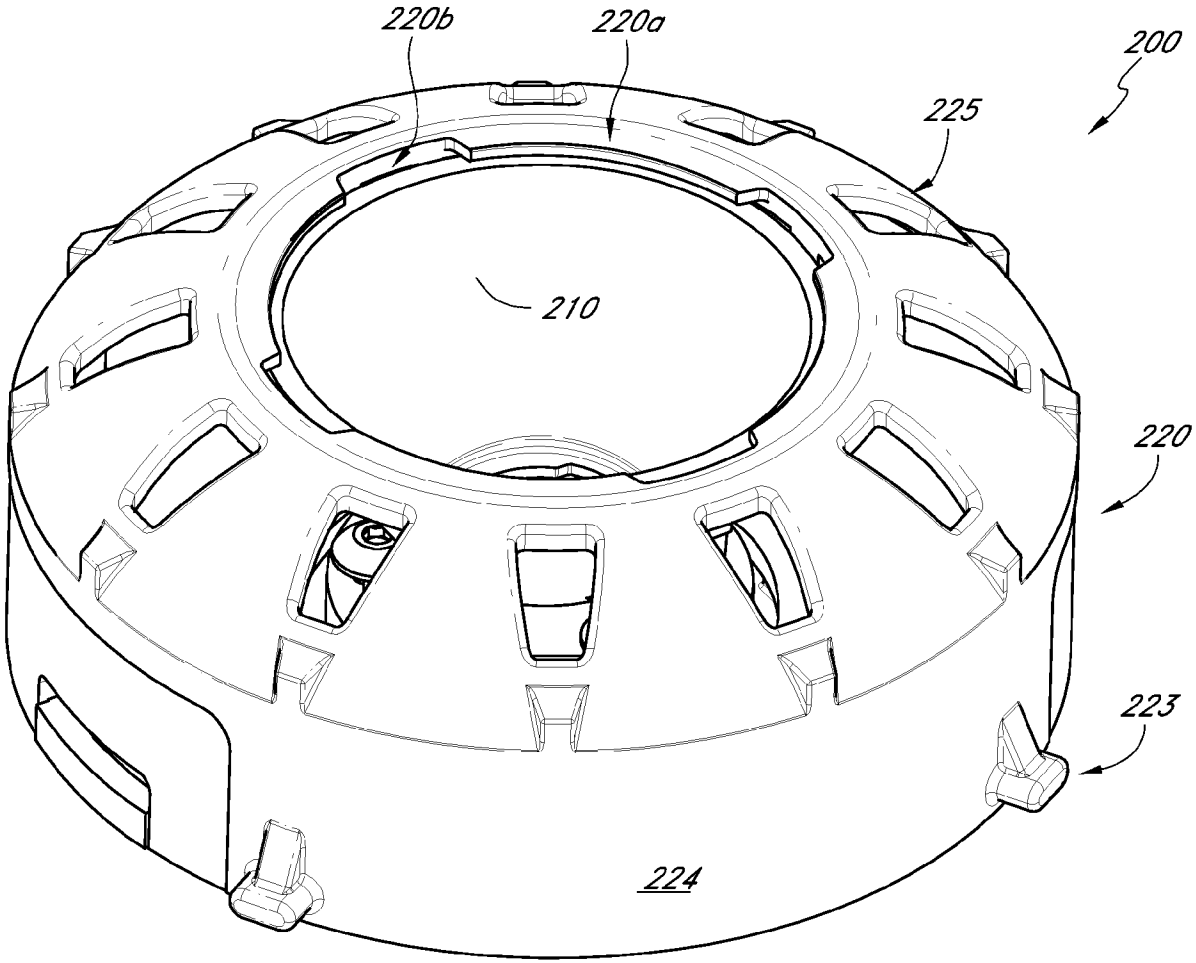
FIG. 1 is a schematic perspective top view of one embodiment of an LED light assembly.

FIGS. 1-5 show one embodiment of an LED light assembly 200. The LED assembly 200 can include a reflector, or optic, 210; a first shell 220; a lighting element, such as an LED 230; a thermally conductive material 240; a printed circuit board 250; a second shell 260; a thermal interface member 270; and a thermal pad 280.

First shell 220 may include an opening 221 sized to receive the optic 210 therein, which can be removably fixed to the first shell 220 via one or more fasteners 222. In the illustrated embodiment, the first shell 220 includes four fasteners 222 for releasably securing the optic 210 to the first shell 220. However, in other embodiments, the first shell 220 can include fewer than, or more than, four fasteners 222. In the illustrated embodiment, the fasteners 222 are hook-like members that can contact an underside of a rim 210*a* of the optic 210, so that the rim 210*a* is held between the fasteners 222 and one or more lip portions 220*a* of the first shell 220. However, in other embodiments, the fasteners 222 can have other suitable configurations. Additionally, recessed portions 220*b* in the opening 221 and adjacent the one or more lip portions 220*a* advantageously allow the optic 210 to be readily disengaged from the first shell 210 and removed from the LED light assembly 200 through the opening 221 without having to disconnect the first and second shells 220, 260. Accordingly, the optic 210 can be easily removed and replaced with another optic 210, for example, to provide a different angle of illumination (e.g., narrow or wide) for the LED light assembly 200. In another embodiment, the optic can be excluded from the LED light assembly 200.

Figure 6:
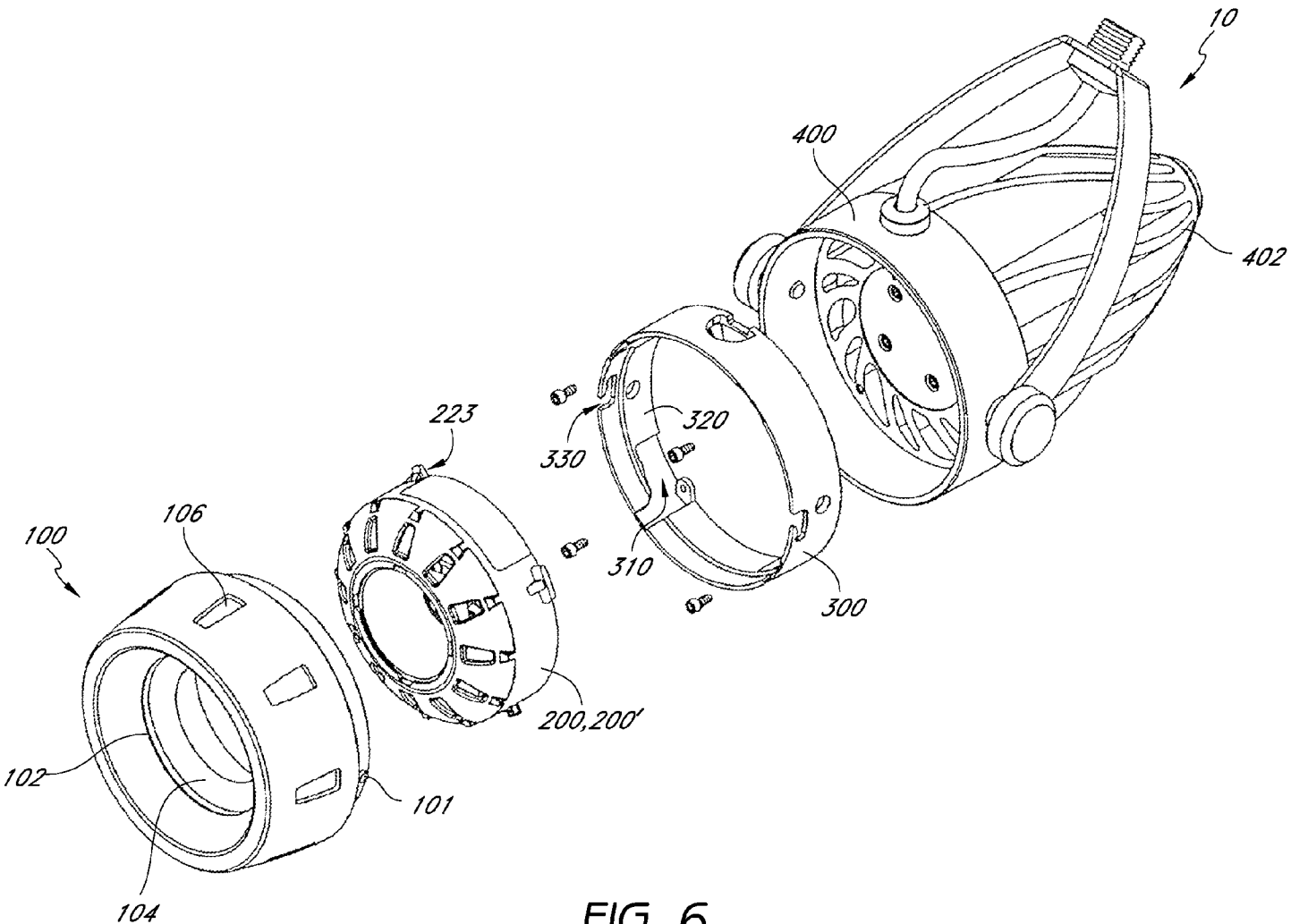
FIG. 6 is a schematic exploded view of one embodiment of an LED light fixture that can incorporate the LED light assembly of FIG. 1.

First shell 220 may also include one or more apertures 225 to facilitate air flow into the LED light assembly 200 to, for example, ventilate the printed circuit board 250, LED 230, and/or a thermally-conductive housing 400 of a light assembly 10 with which the LED light assembly 200 is coupled (see FIG. 6). Additionally, the number, shape and/or location of the apertures 225 can also be varied in other embodiments. Further, in certain applications, the airflow apertures 225 can be omitted (e.g., where ventilation of the LED light assembly 200 is not required).

First shell 220 may also include one or more engaging members 223, such as protrusions or tabs, on its outer surface 224. In the illustrated embodiment, the first shell 220 has four engaging members 223. However, in other embodiments the first shell 220 can include fewer or more engaging members 223. In the illustrated embodiment, the engaging members 223 are shown as being "t-shaped" tabs, but the engaging members 223 can have any suitable shape (e.g., L-shaped, J-shaped), and can be positioned on other surfaces of the LED light assembly 200, such as the bottom surface of the assembly 200.

Figure 2:
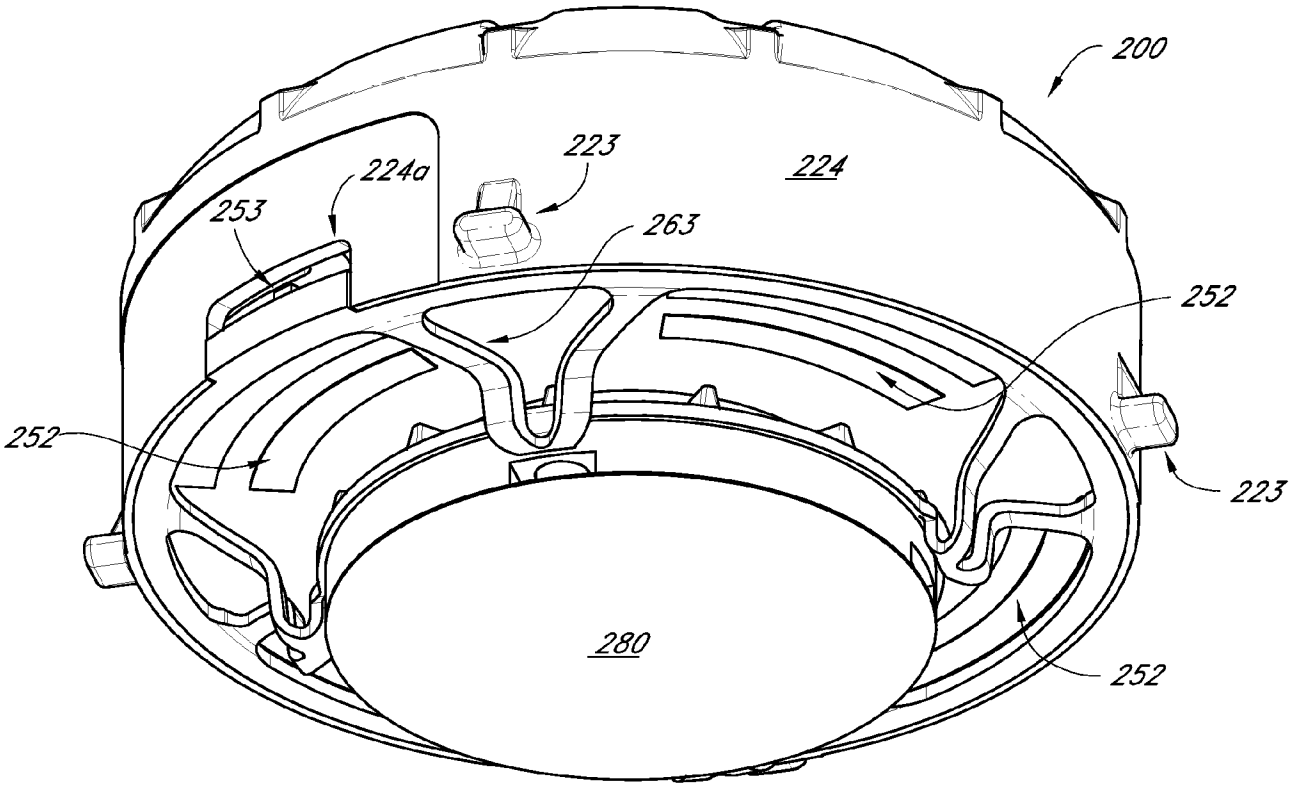
FIG. 2 is a schematic perspective top view of the LED light assembly of FIG. 1.
Figure 3:
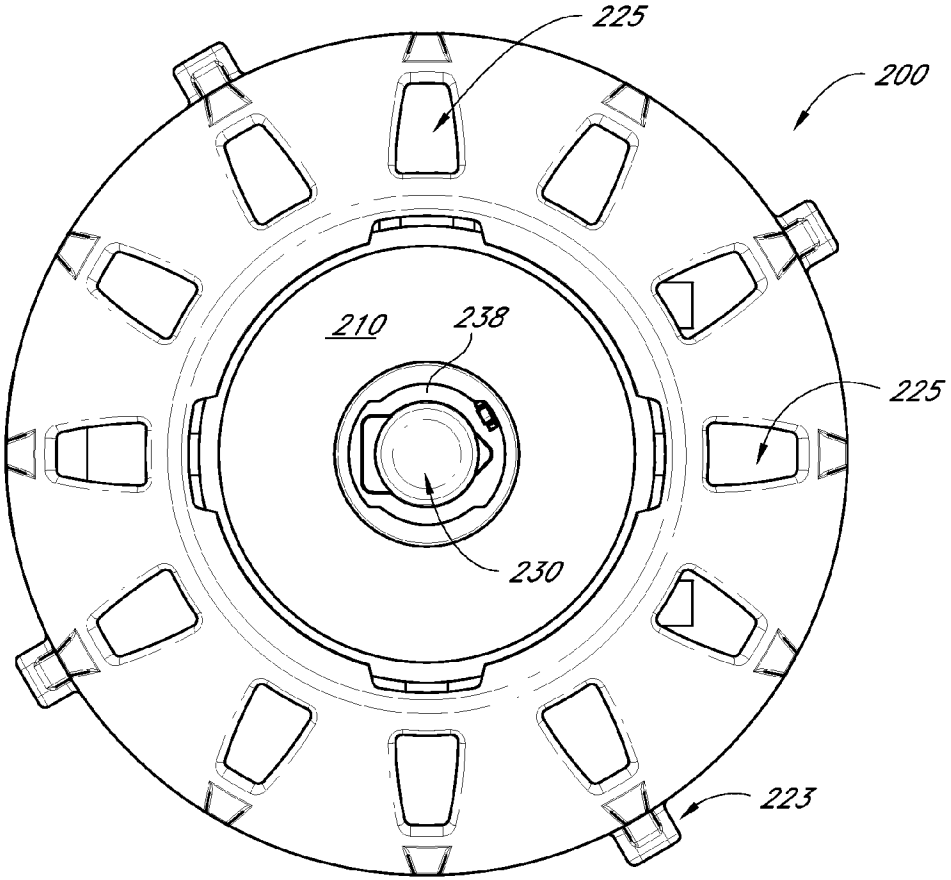
FIG. 3 is a schematic top view of the LED light assembly of FIG. 1

With continued reference to FIG. 2, the second shell 260 can include one or more resilient members 263, which can include resilient ribs or springs 263*a*. In the illustrated embodiment, the second shell 260 includes four resilient members 263. However, in other embodiments, the second shell 260 can include more or fewer resilient members 263. Additionally, in the illustrated embodiment, the resilient member 263 has a wishbone-like shape. However the resilient member 263 can have other suitable shapes in other embodiments. In one embodiment, the resilient member 263 can be made of the same material as the rest of the second shell 260. In another embodiment, the resilient member 263 can be made of a different material than the rest of the second shell 260. In one embodiment, the resilient member 263 can be made of metal, such as stamped stainless steel. However, the resilient member 263 can be made of other suitable materials, such as a plastic material, including a shape memory plastic material.

The thickness and width of the resilient member 263 can be adjusted in different embodiments to increase or decrease the spring force provided by the resilient member 263. The resilient member 263 can include an opening between the ribs 263*a* that can have any suitable size or shape to, for example, adjust the flexibility of the resilient member 263. The resilient members 263 in second shell 260 preferably provide the desired spring force to generate a compression force between the LED light assembly 200 and the housing 400 of the light assembly 10 (see FIG. 6) to effect a resilient thermal coupling between the LED light assembly 200 and the thermally-conductive housing 400 so that heat can be effectively dissipated from the LED light assembly 200 to the housing 400. In another embodiment, a gasket (e.g., annular gasket) of resilient material can be disposed adjacent an attachment ring 262 of the second shell 260 so that the gasket provides an interface between the ring 262 and a portion of the circuit board 250. Said gasket can also provide a compression force, in addition to the compression force provided by the resilient members 263, to achieve the desired thermal coupling between the LED light assembly 200 and the housing 400. In another embodiment (not shown), the compression force between the LED light assembly 200 and the housing 400 can be provided solely by a gasket between the ring 262 and the circuit board 250.

In the illustrated embodiment, the ring 262 of the second shell 260 can have one or more compression limiter tabs 266. In the illustrated embodiment, the ring 262 has twelve compression limiter tabs 266. However, in other embodiments, the ring 262 can have more or fewer compression limiter tabs 266. The compression limiter tabs 266 preferably limit the deflection of the resilient members 263 when the attachment ring 262 is moved toward the printed circuit board 250 (e.g., via the movement of the thermal interface member 270 when the LED light assembly 200 is coupled to the housing 400) to thereby maintain the resiliency and elasticity of the resilient members 263 and inhibit the over-flexing (e.g., plastic deformation) of the resilient members 263. In another embodiment, where the LED light assembly 200 includes an optic 210, the optic 210 can engage the LED 230 to limit the travel of the attachment ring 262 relative to the printed circuit board 250 to inhibit damage to the resilient members 263.

The second shell 260 can also include one or more positioning elements 264 that can engage corresponding recesses 251 in the printed circuit board 250 to ensure the desired orientation and position of the printed circuit board 250 and to hold printed circuit board 250 in a desired orientation (e.g., inhibit rotation of the circuit board 250) between first shell 220 and second shell 260. Each positioning element 264 may also engage a receiver 220*c* in the first shell 220 to secure the second shell 260 to the first shell 220. First and second shells 220, 260 may be made of any plastic or resin material such as, for example, polybutylene terephthalate. However, the shells 220, 260 can be made of other suitable materials, such as a metal (e.g., a die cast metal).

The printed circuit board 250 can have one or more electrical contact portions 252 on a rear side of the printed circuit board 250, so that the contact portions 252 face toward the resilient members 263 of the second shell 260. The electrical contact portion 252 can preferably engage a corresponding electrical contact 361 (see FIG. 7) in the housing 400, which can be electrically connected to a power source. Accordingly, placing the electrical contact portion 252 in contact with the electrical contact of the housing 400 allows for power to be provided to the LED light assembly 200 to provide light. The printed circuit board 250 is preferably electrically coupled to the LED 230 and controls the operation of the LED 230. In the illustrated embodiment, the LED light assembly 200 can include a wattage adjust control 253 (e.g., a switch) that can be accessed by a user. In one embodiment, the wattage adjust control 253 can be accessed through an opening 224*a* in the first shell 220 of the LED light assembly 200. Advantageously, the wattage adjust control 253 can be operatively connected to the LED 230 so that a user can manually adjust the wattage of the LED light assembly 200 by adjusting the wattage adjust control 253. In one embodiment, the wattage adjust control 253 can be actuated to vary the wattage of the LED light assembly 200 between a variety of predetermined wattage set points (e.g., between 6 W, 8 W and 10 W). In one embodiment, the wattage adjust control 253 can be electrically connected to the printed circuit board 250.

In the illustrated embodiment, the circuit board 250 has four electrical contact portions 252, each positioned between two resilient members 263, which advantageously allows a user to bring the LED light assembly 200 into electrical contact with the electrical contact 361 (see FIG. 7) of the housing 400 irrespective of the orientation of the LED light assembly 200 when coupled to the housing 400, which facilitates the installation of the LED light assembly 200. This is particularly useful where the light fixture assemblies 10 are attached to high ceilings that require a user to reach up to the light fixture 10 to install the LED light assembly 200. The multiple electrical contact portions 252 ensure that the user will correctly install the LED light assembly 200 on the first try, as opposed to a LED light assembly 200 with only one electrical contact portion 252, where the user may need more than one try to effectively bring the electrical contact portion 252 of the LED light assembly 250 into contact with the corresponding electrical contact 361 of the housing 400. In other embodiments, the circuit board 250 can have fewer or more contact portions 252.

Figure 4:
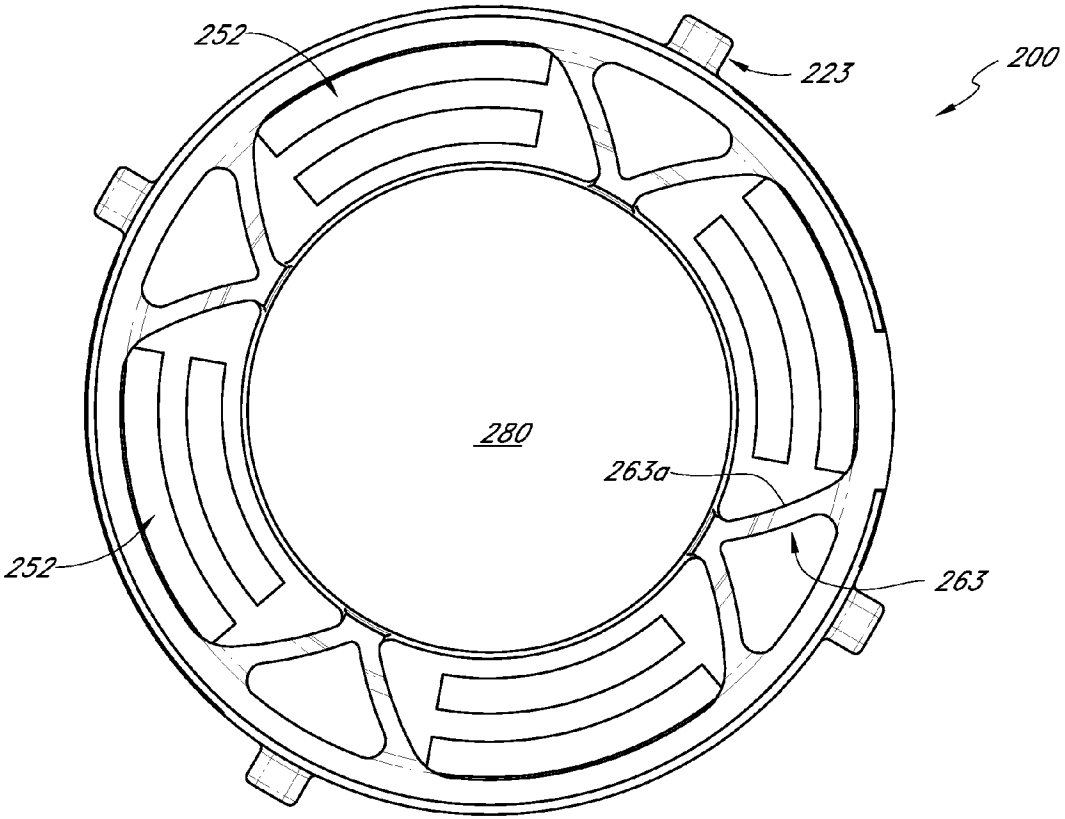
FIG. 4 is a schematic bottom view of the LED light assembly of FIG. 1.

In one embodiment, the electrical contact portions 252 can be gold plated to provide effective electrical contact between the LED light assembly 250 and the housing 400. However, in other embodiments, the electrical contact portions 252 can include other suitable electrically conductive materials, such as tin (e.g., via solder tinning). In some embodiments, the electrical contact portions 252 can be in the form of strips or pads. In another embodiment, the electrical contact portions 252 can have a curved or arc shape, as shown in FIG. 4. However, the electrical contact portions 252 can have other suitable shapes.

Figure 5:
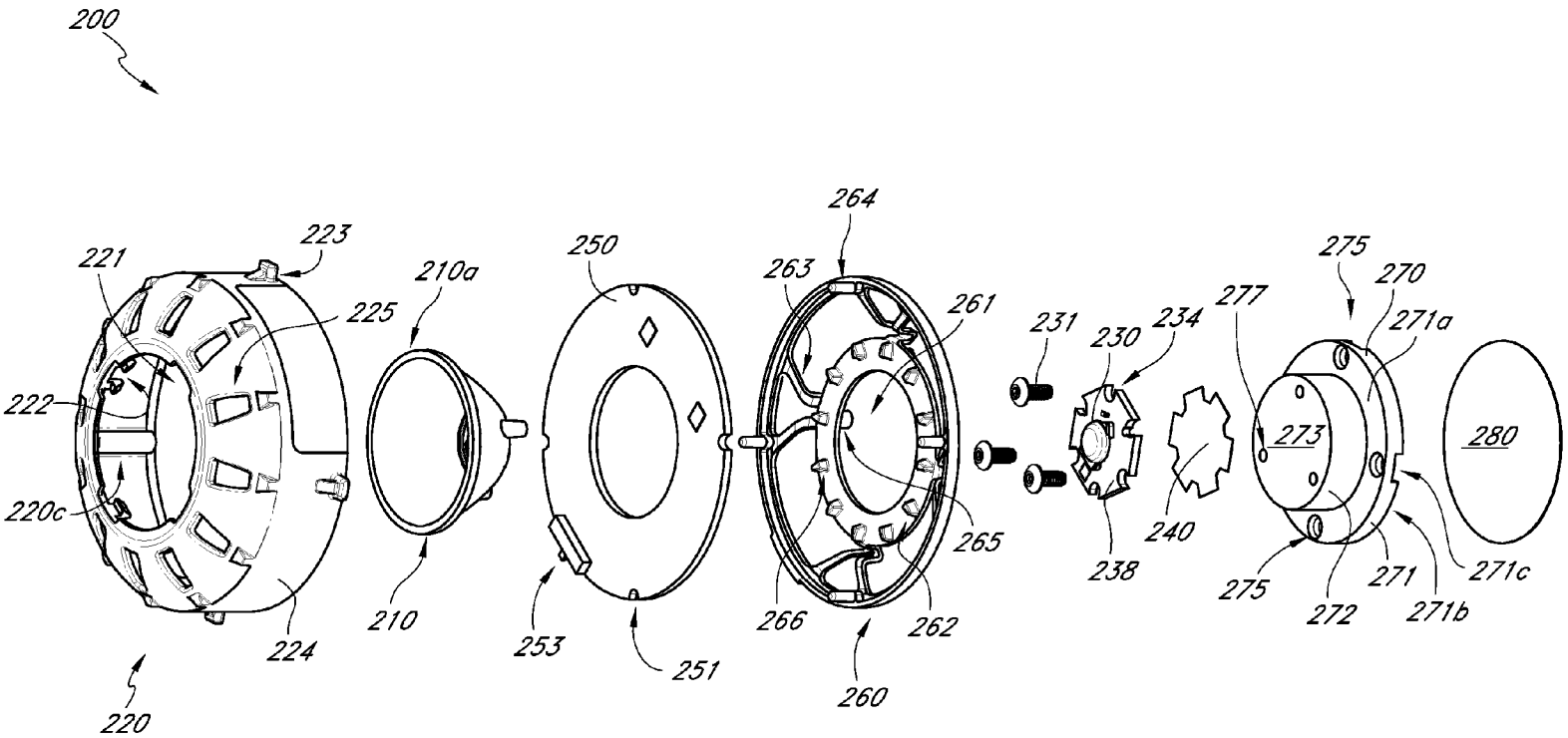
FIG. 5 is a schematic exploded perspective view of the LED light assembly of FIG. 1.

With continued reference to FIG. 5, the second shell 260 may also include an opening 261 sized to receive therethrough at least a portion of the thermal interface member 270. The thermal interface member 270 can be fixed to the second shell 260 through one or more attachment members (not shown), such as screws or other known fasteners, that can be inserted through openings 275 in the thermal interface member 270 and engage corresponding bosses 265 in the second shell 260. However, the interface member 270 can be fixed to the second shell 260 in other suitable manners, such as, for example, via a press-fit connection. The thermal interface member 270 can also be fixed to a thermal pad 280, via which the LED light assembly 200 can be in thermal contact, for example, with the housing 400, as discussed further below.

The thermal interface member 270 may include an upper portion 271 with a top surface 271*a* and a bottom surface 271*b* with recessed portions 271*c* aligned with the openings 275, and a lower portion 272 with a circumference smaller than the circumference of upper portion 271. With continued reference to FIG. 5, the lower portion 272 of the thermal interface member 270 can be inserted through opening 261 of second shell 260 such that upper portion 271 engages the second shell 260 (e.g., via the bosses 265 and openings 275, as discussed above). The second shell 260 may be formed of any plastic or resin material such as, for example, polybutylene terephthalate. In another embodiment, the second shell 260 can be formed of, for example, nylon and/or thermally conductive plastics such as plastics made by Cool Polymers, Inc., known as CoolPoly®. However, other suitable materials, including metallic materials, can be used.

Referring now to FIGS. 4 and 5, the thermal pad 280 may be attached to thermal interface member 270 via an adhesive or any other suitable fastener so as to substantially fill microscopic gaps and/or pores between the surface of the thermal interface member 270 and thermally-conductive housing 400 to thereby minimize the thermal impedance between the thermal interface member 270 and the housing 400 when the LED light assembly 200 is coupled to the housing 400. The thermal pad 280 may be any suitable commercially available thermally conductive pad, such as, for example, Q-PAD 3 Adhesive Back, manufactured by The Bergquist Company. However, in other embodiments, the thermal pad 280 can be omitted from the LED light assembly 200.

With continued reference to FIG. 5, the lower portion 272 of thermal interface member 270 can facilitate the positioning of the LED 230 in LED assembly 200. In the illustrated embodiment, the LED 230 can be mounted to a surface 273 of lower portion 272 using fasteners 231, which may be screws, bolts, rivets, or other suitable fasteners. In the illustrated embodiment, the fasteners 231 are screws that can be inserted through recesses 234 in a substrate 238 on which the LED 230 is mounted, so that the screws extend into openings 277 on the surface 273 of the lower portion 272. The fasteners 231 advantageously fasten the LED 230 to the thermal interface member 270 as well as inhibit the rotation of the LED 230 once fixed to the thermal interface member 270 via the interaction of the fasteners 231 and the recesses 234. A thermally conductive material 240 can in one embodiment be positioned between LED 230 and surface 273. In another embodiment, the LED 230 is fastened to the surface 273 without the use of a thermally conductive material 240.

The machining of both the bottom surface of LED 230 and surface 273 during the manufacturing process may leave minor imperfections in these surfaces, forming voids. These voids may be microscopic in size, but may act as an impedance to thermal conduction between the bottom surface of LED 230 and surface 273 of thermal interface 270. Thermally conductive material 240 may facilitate the conduction of heat between the LED 230 and the surface 273 of the thermal interface member 270 by substantially filling these voids to reduce the thermal impedance between LED 230 and surface 273, resulting in improved thermal conduction and heat transfer. In one embodiment, the thermally conductive material 240 may be a phase-change material which changes from a solid to a liquid at a predetermined temperature, thereby improving the gap-filling characteristics of the thermally conductive material 240. For example, thermally conductive material 240 may include a phase-change material such as, for example, Hi-Flow 225UT 003-01, which is designed to change from a solid to a liquid at 55° C. and is manufactured by The Bergquist Company.

In one embodiment, the thermal interface member 270 may be made of aluminum and is shown as resembling a "top hat," various other shapes, sizes, and/or materials with suitable thermal conductivity could be used for the thermal interface member to transport and/or spread heat. In another embodiment, thermal interface member could have a planar or "pancake" shape with a single diameter. Additionally, while the LED 230 is shown as being mounted to the substrate 238, the LED 230 need not be mounted to the substrate 238 and may in other embodiments be directly mounted to thermal interface member 270 (see FIG. 9). The LED 230 may be any appropriate commercially available single- or multiple-LED chip, such as, for example, an OSTAR 6-LED chip manufactured by OSRAM GmbH, having an output of 400-650 lumens.

In the embodiments disclosed above, the LED light assembly 200 advantageously requires few fasteners to assemble the LED light assembly 200, which reduces manufacturing cost and time. For example, in the illustrate embodiment, the LED light assembly can be assembled simply with the use of fasteners 231 to fasten the LED 230 to the thermal interface member 270, and fasteners (not shown), such as screws to fasten the top portion 271 of the thermal interface member 270 to the bosses 265 of the second shell 260. In another embodiment (not shown), the thermal interface member 270 and second shell 260 can be fastened without using screws or similar fasteners. For example, in some embodiments, a press-fit, quick disconnect or clip-on manner can be used to fasten the thermal interface member 270 to the second shell 260. Similarly, in certain embodiments, the substrate 238 to which the LED 230 is mounted can be fastened to the surface 273 of the thermal interface member 270 with an adhesive or other mechanism that does not include the use of elongate fasteners 231, such as screws and bolts.

FIG. 6 is an exploded perspective view of one embodiment of a light fixture assembly 10 with which the LED light assembly 200 embodiments disclosed herein can be used. The light fixture assembly 10 can include a front cover 100, the LED light assembly 200, a socket 300 and a thermally-conductive housing 400 to which the socket 300, in one embodiment, can be coupled.

In one embodiment, the socket 300 can be ring shaped. In another embodiment, the socket 300 can have a back plate and a circumferential wall that define a cavity or recess therebetween. In another embodiment, the back plate and circumferential wall are one piece. In still another embodiment the back plate and circumferential wall can be separate pieces removably attachable to each other. The socket 300 can be of a die cast metal or plastic. For example, the socket 300 can in one embodiment be made of aluminum.

Figure 7:
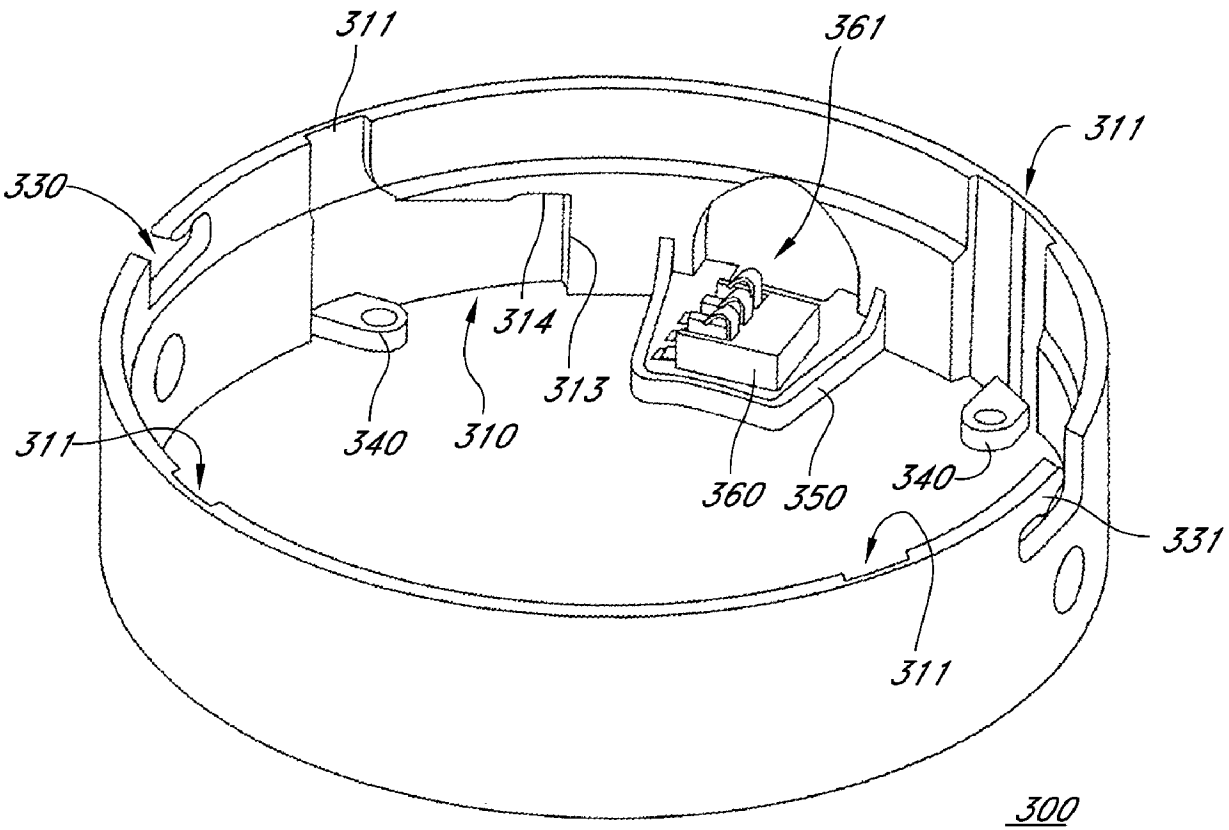
FIG. 7 is a schematic perspective top view of the socket in FIG. 6.

With reference to FIGS. 6 and 7, the socket 300 can releasably lock the LED light assembly 200 in place within the light fixture assembly 10. In the illustrated embodiment, the socket 300 includes one or more recesses or slots 310 in the wall 320 of the socket 300, where the recesses 310 can define a path (e.g., J-shaped, L-shaped, etc.) from an opening 311 at a rim of the socket 300 through a horizontal recess 314 to a stop portion 313. The engaging members 223 of the LED light assembly 200 can be inserted into the slots 310 of the socket 300 to releasably couple the LED light assembly 200 to the socket 300. For example, the LED light assembly 200 can be inserted into the socket 300 and then rotated so that the engaging members 223 follow the path defined by the opening 311, horizontal recess 314 and stop portion 313 to engage an edge defined by the recess 310 of the socket 300 to lock the LED light assembly 200 in place in the socket 300. In the illustrated embodiment, the LED light assembly 200 can be rotated in the opposite direction to allow the engaging members 223 to disengage the edge of the recess 310 and the LED light assembly 200 to be removed from the socket 300. However, in other embodiments, the LED light assembly 200 and the housing 400 can be releasably coupled via other suitable mechanisms (e.g., via a threaded connection, a clamped connection, etc.).

With continued reference to FIG. 7, the socket 300 can be fastened to the housing 400 via one or more fastening members 340. In the illustrated embodiment, the fastening member 340 is a tab through which a fastener (e.g., bolt, screw, rivet) can be inserted to fasten the socket 300 to the housing 400. In another embodiment, the socket 300 and the thermally-conductive housing 400 can be one piece.

As shown in the embodiment of FIG. 7, the socket 300 can have a tray 350 that supports a terminal block 360 with at least one electrical contact 361. The recesses 310 in the socket 300 are preferably dimensioned to allow at least one of the electrical contact portions 252 of the printed circuit board 250 to contact the electrical contact 361 when the LED light assembly 200 is coupled to the thermally-conductive housing 400 via the socket 300 to thereby establish an electrical connection between the LED light assembly 200 and the housing 400. The terminal block 360 can be connected to a power source (e.g., a battery, a residential power supply via an electrical cord), so as to supply electricity to the LED light assembly 200 when the LED light assembly 200 is coupled to the housing 400. Additionally, in one embodiment, the recesses 310 are preferably dimensioned to cause the flexible members 263 to compress as the engaging members 223 are moved along the paths defined by the recesses 310, thereby generating a compression force between the thermal interface member 270 and the thermally-conductive housing 400 to thereby establish a thermal connection between the LED light assembly 200 and the thermally-conductive housing 400.

In one embodiment, when the LED light assembly 200 is installed in the housing 400, the compression force generated by the resilient member 263 causes a subassembly of the LED light assembly 200 to travel relative to the first shell 220. In one embodiment, the subassembly includes the thermal interface member 270 and LED 230, which move toward the opening 221 of the first shell 220 when the LED light assembly is installed in the housing 400. In one embodiment, when the LED light assembly 200 is removed from engagement with the housing 400, the subassembly can travel in the opposite direction (e.g., the thermal interface member 270 and LED 230 can move away from the opening 221 of the first shell 220. In one embodiment, the LED 230 is positioned out of the focal point of the reflector or optic 210 when the LED light assembly 200 is decoupled from the housing 400, but the spring force of the resilient member 263 causes the LED 230 to move into the focal point of the optic 210 as the LED light assembly 200 is coupled to the housing 400. In one embodiment, the subassembly can also include the circuit board 250, which can be fixed to the thermal interface member 270, so that the circuit board 250 can also travel as the LED light assembly 200 is installed in the housing, or disengaged from the housing. In another embodiment, the subassembly can include the optic 210, which can be coupled to the thermal interface member 270, so that the optic 210 can also travel as the LED light assembly 200 is installed in the housing or removed from the housing. In still another embodiment, both the circuit board 250 and optic 210 can be coupled to the thermal interface member 270 and travel relative to the first shell 220 when the LED light assembly 200 is installed with, or disengaged from, the housing 400. However, the subassembly can include other components.

With continued reference to FIG. 6, after LED assembly 200 is installed in thermally-conductive housing 400, a front cover 100 may be attached to socket 300 by engaging front cover engaging member 101 on the front cover 100 with front cover retaining mechanism 330, and rotating front cover 100 with respect to socket 300 to secure the front cover engaging member 101 with a front cover retaining mechanism lock 331 (e.g., slot) to lock the front cover 100 in place. The front cover 100 may include a main aperture 102 formed in a center portion of cover 100, a transparent member, such as a lens 104 formed in aperture 102, and one or more peripheral holes 106 formed on a periphery of front cover 100. The lens 104 allows light emitted from a lighting element (e.g., LED 230) to pass through the cover 100, while also protecting the lighting element from the environment. The lens 102 may be made from any appropriate transparent material to allow light to flow therethrough, with minimal reflection or scattering.

As shown in FIG. 6, the front cover 100, LED light assembly 200, socket 300, and thermally-conductive housing 400 may be formed from materials having a thermal conductivity k of at least 12 W/mK, and preferably at least 200 W/mK, such as, for example, aluminum, copper, or thermally conductive plastic. However, other suitable materials can be used. The front cover 100, LED assembly 200, socket 300, and thermally-conductive housing 400 may be formed from the same material, or from different materials. The one or more peripheral holes 106 may be formed on the periphery of front cover 100 such that they are equally spaced and expose portions along an entire periphery of the front cover 100. Although a plurality of peripheral holes 106 are shown in the illustrated embodiment, one or more peripheral holes 106 or none at all can be used in other embodiments. The peripheral holes 106 can advantageously allow air to flow through front cover 100, into and around the LED assembly 200 and flow through air holes in the thermally-conductive housing 400 to dissipate heat generated by the LED 230.

Additionally, as shown in FIG. 6, the one or more peripheral holes 106 may be used to allow light emitted from LED 230 to pass through peripheral holes 106 to provide a corona lighting effect on front cover 100. In one embodiment, the thermally-conductive housing 400 may be made from an extrusion process, including a plurality of surface-area increasing structures, such as ridges 402. Further details on the thermally conductive housing 400 and light fixture assemblies 10 with which the LED light assembly 200 can be used are provided in U.S. patent application Ser. Nos. 11/715,071 and 12/149,900, the entire contents of both of which are hereby incorporated by reference in their entirety and should be considered a part of this specification.

The ridges 402 may serve multiple purposes. For example, ridges 402 may provide heat-dissipating surfaces so as to increase the overall surface area of the thermally-conductive housing 400, thereby providing a greater surface area for heat to dissipate to an ambient atmosphere over. That is, the ridges 402 may allow the thermally-conductive housing 400 to act as an effective heat sink for the light fixture assembly 10. Moreover, the ridges 402 may also be formed into any of a variety of shapes and formations such that thermally-conductive housing 400 takes on an aesthetic quality. That is, the ridges 402 may be formed such that thermally-conductive housing 400 is shaped into an ornamental extrusion having aesthetic appeal. However, the thermally-conductive housing 400 may be formed into a plurality of other shapes, and thus function not only as a ornamental feature of the light fixture assembly 10, but also as a heat sink to dissipate heat from the LED 230.

Figure 8B:
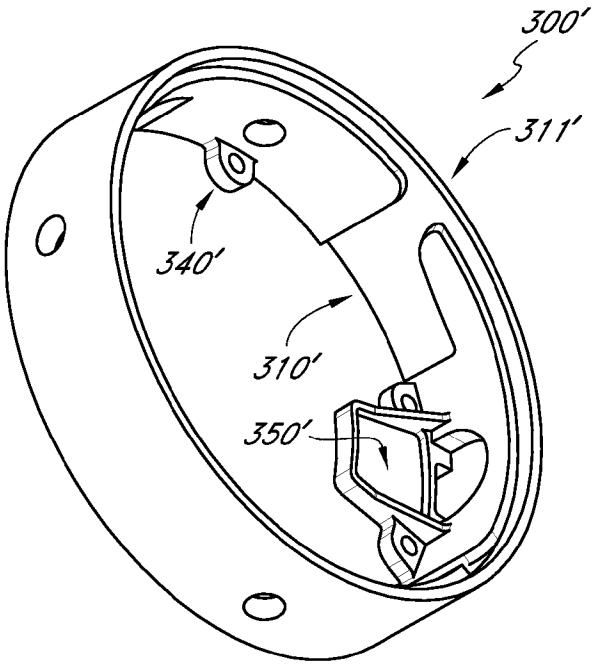
FIGS. 8A-B are schematic perspective bottom and top views, respectively, of another embodiment of a socket.
Figure 8A:
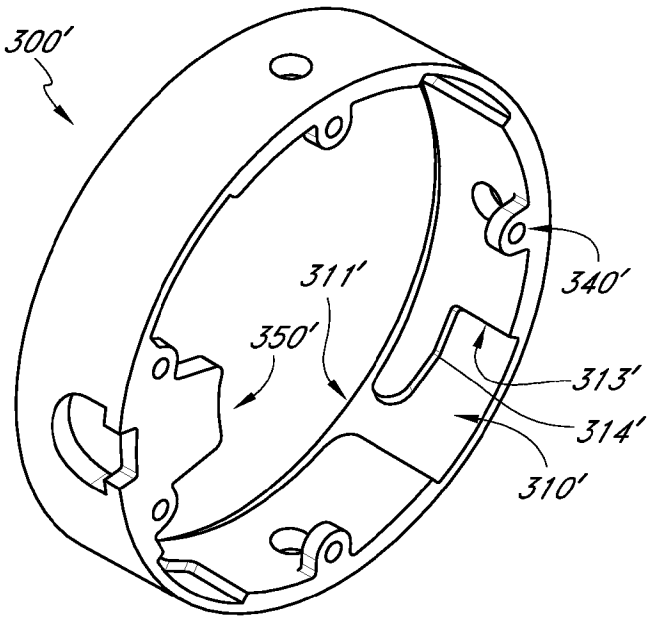

FIGS. 8A and 8B show another embodiment of a socket 300' that can be used to releasably lock the LED light assembly 200. The socket 300' is similar to the socket 300, except as noted below. Thus, the reference numerals used to designate the various features of the socket 300' are identical to those used for identifying the corresponding features of the socket 300 in FIG. 7, except that a "'" has been added to the reference. The socket 300' differs from the socket 300 in that it does not have the front cover retaining mechanism 330 or front cover retaining mechanism lock 331 to lock the front cover 100 to the thermally-conductive housing 400. Rather, other suitable mechanisms can be used to lock the front cover 100 to the thermally-conductive housing 400, such as a press-fit connection.

Figure 9:
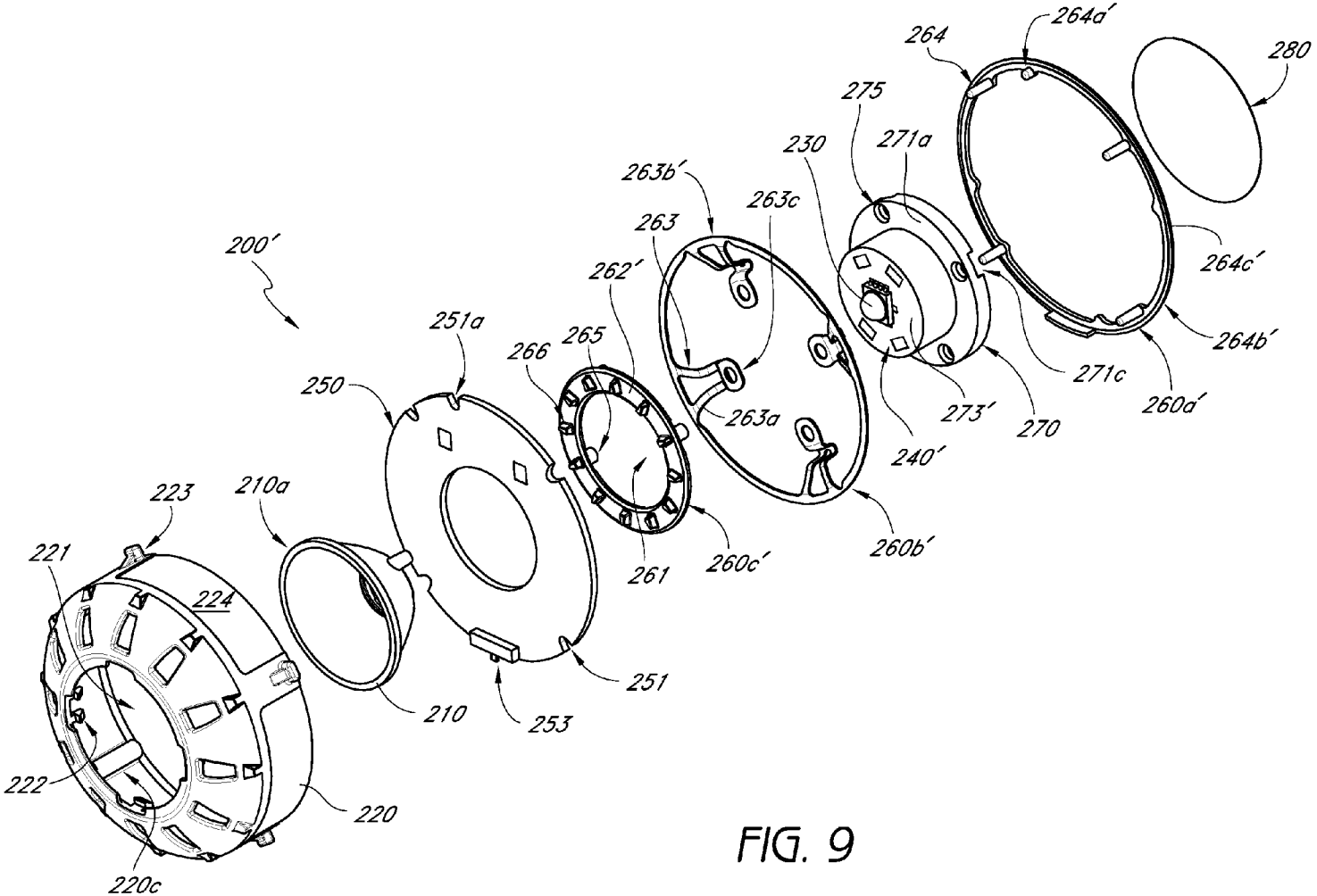
FIG. 9 is a schematic exploded perspective view of another embodiment of an LED light assembly.
Figure 10:
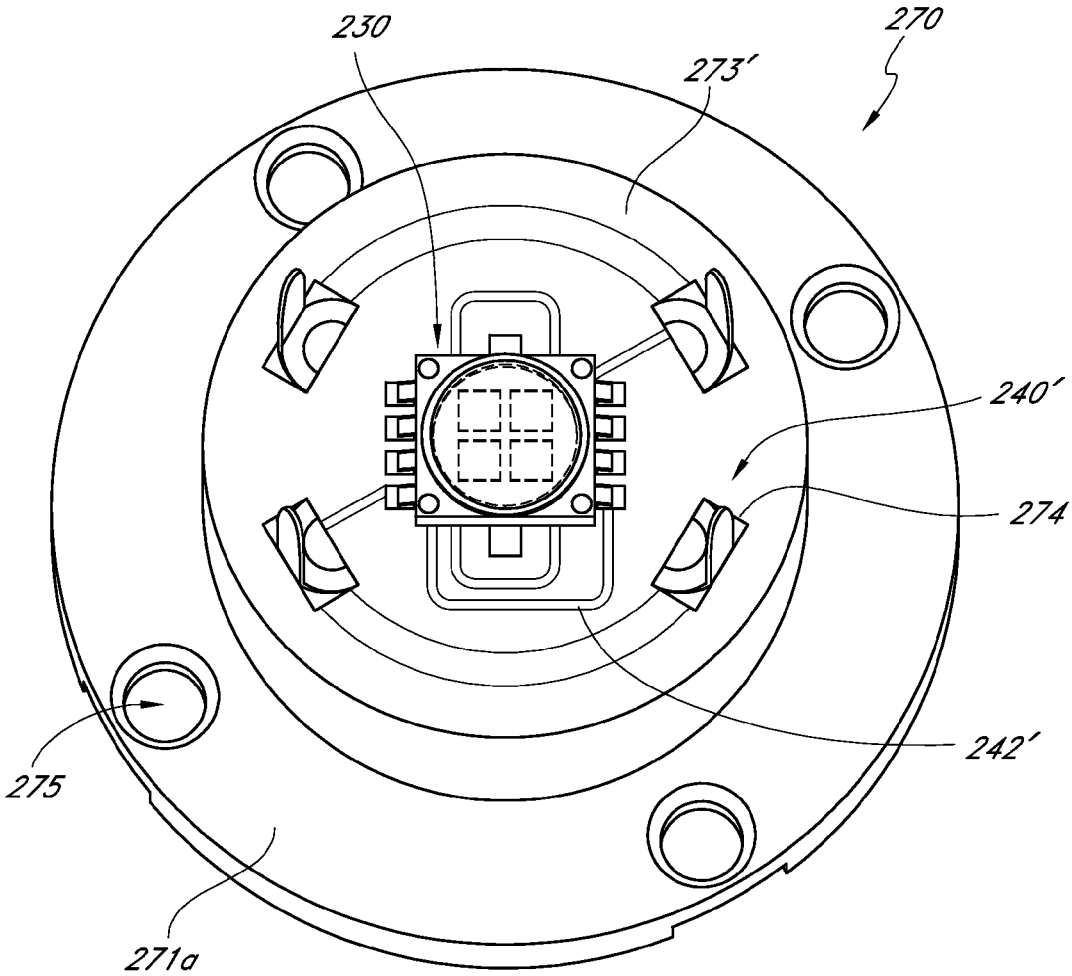
FIG. 10 is a perspective top view of a component of the LED light assembly of FIG. 9.

FIGS. 9 and 10 illustrate another embodiment of an LED light assembly 200', which can be used with the light fixture assembly 10 and the socket 300, 300' disclosed herein. The LED light assembly 200' is similar to the LED light assembly 200, except as noted below. Thus, the reference numerals used to designate the various components of the LED light assembly 200' are identical to those used for identifying the corresponding components of the LED light assembly 200 in FIGS. 1-5, except that a "'" has been added to the reference numerals of the LED light assembly 200'.

As shown in FIG. 9, the LED light assembly 200' includes a second shell assembly 260' that includes a locking assembly 260*a*', a resilient assembly 260*b*' and a compression limiting assembly 260*c*' as separate components. In the illustrated embodiment, the resilient assembly 260*b*' is made of metal and the locking assembly 260*a*' and compression limiting assembly 260*c*' are made of a plastic material. However, in other embodiments, the locking assembly 260*a*', resilient assembly 260*b*' and compression limiting assembly 260*c*' can all be made of metal, or all be made of a plastic material, or at least one of the three components 260*a*', 260*b*', 260*c*' can be made of a different material than the remaining components 260*a*', 260*b*', 260*c*'.

In the illustrated embodiment, the locking assembly 260*a*' is ring-shaped with positioning elements 264, as described above, that can engage corresponding recesses 251 in the printed circuit board 250 and receiving members 220*c* in the first shell 220. The locking assembly 260*a*' can also have an orientation marker 264*a*' that can engage a corresponding recess 251*a* in the printed circuit board to ensure a desired orientation of the locking assembly 260*a*' relative to the printed circuit board 250.

The locking assembly 260*a*' can be fastened to the resilient assembly 260*b*' by aligning a rim 263*b*' of the resilient assembly 260*b*' with a rim 264*b*' of the locking assembly 260*a*'. In one embodiment, the rim 263*b*' of the resilient assembly 260*b*' can be held between a lip 264*c*' of the rim 264*b*' and the positioning elements 264.

The compression limiting assembly 260*c*' can be fastened to the resilient assembly 260*b*' by inserting the bosses or members 265 through openings in tabs 263*c*' of the resilient assembly 260*b*'. The bosses 265 can further be inserted through openings 275 in the thermal interface member 270 so that the bosses 265 extend into the recesses or slots 271*c* on the back surface 271*b* of the thermal interface member 270, and so that the tabs 263*c*' contact with the top surface 271*a* of the thermal interface member 270. The ends of the bosses 265 that extend into the recesses 271*c* can then be melted or heat staked to fasten the second shell assembly 260' to the thermal interface member 270. However, other suitable mechanisms can be used to fasten the second shell assembly 260' to the thermal interface member 270. In another embodiment, fasteners (e.g., bolts, screws, rivets) can be inserted through the openings 275 and coupled to the bosses 265 (e.g., threadably coupled to the bosses 265 where the bosses 265). In another embodiment, the bosses 265 can be press-fitted into the openings 275.

Advantageously, the second shell assembly 260' can be assembled, as described above and illustrated in FIG. 9, without the use of separate fasteners, such as screws, bolts or rivets, which results in a reduction in manufacturing cost and time. Moreover, the second shell assembly 260' can also be fastened to the first shell 220 without the use of separate fasteners.

With reference to the embodiment of FIG. 10, the LED 230 is directly mounted to, or populated onto, the thermal interface member 270. In the illustrated embodiment, a dielectric layer 240' that is thermally conductive and electrically insulating is applied to the surface 273' of the thermal interface member 270. In one embodiment, the dielectric layer 240' is screen printed onto the surface 273' of the thermal interface member 270. A trace pattern 242' can then be screen printed on top of the dielectric layer 240'. In one embodiment, a solder mast 274 is applied to cover the dielectric layer 240' and trace pattern 242', leaving only the portions of the trace pattern 242' exposed to which soldering is desired. Solder masts or terminations 274 are attached to the dielectric layer 240' and are electrically connected to the trace pattern 242', where the solder masts 274 can be electrically coupled to the circuit board 250. The LED 230 is populated onto the dielectric layer 240' so that the terminations (e.g., pins, leads) of the LED 230 are electrically connected to the trace pattern 242'. The LED 230 can be populated onto the dielectric layer 240' using an automation process, such as an SMT (surface mount technology) method. In another embodiment, the LED 230 can be attached directly to the surface 273' of the thermal interface member 270 without a dielectric layer positioned therebetween.

Figure 11B:
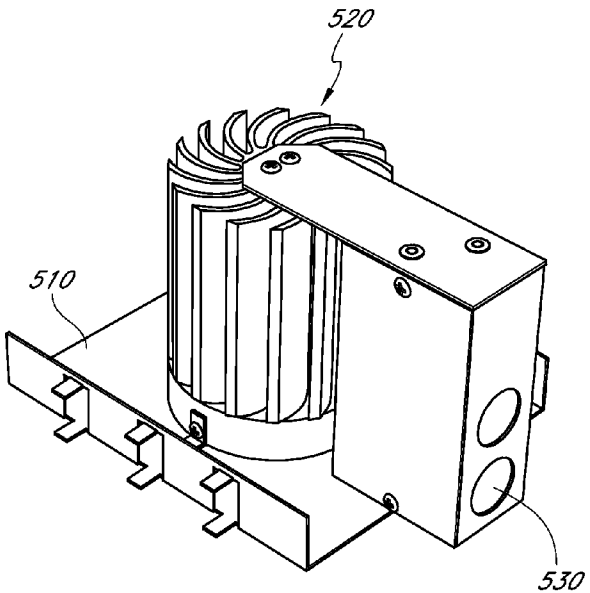
FIGS. 11A-B are a schematic exploded perspective bottom view and an assembled perspective top view, respectively, of another embodiment of an LED light fixture that can incorporate the LED light assembly of FIGS. 1 and 9.
Figure 11A:
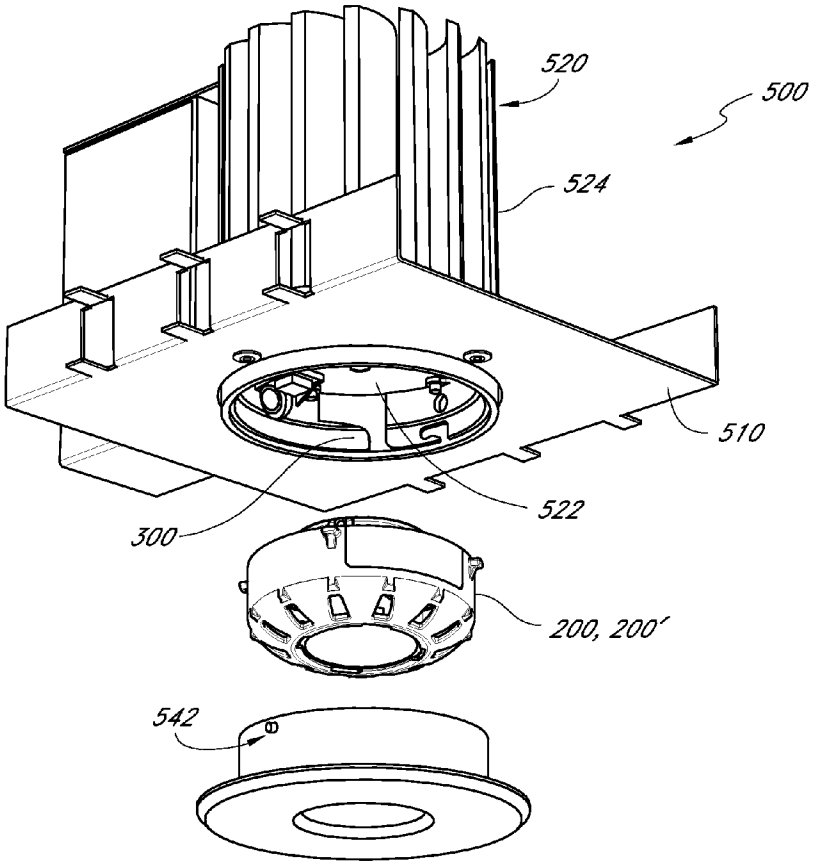

FIGS. 11A-B show another embodiment of a light fixture assembly 500 with which the LED light assembly 200, 200' embodiments disclosed herein can be used. The light fixture assembly 500 can include a mounting plate 510 and a thermally-conductive housing 520 with a recessed opening 522 that can receive the socket 300, 300' therein. In another embodiment, the socket 300, 300' can be integrally formed with the thermally conductive housing 520. The LED assembly 200, 200' can thus be coupled to the housing 520 via the socket 300, 300' and the housing 400 can serve as a heat sink to conduct heat away from the LED assembly 200, 200'. Additionally, the housing 400 can have one or more fins 524 for dissipating to the environment via convection heat transfer. The light fixture assembly 500 can also have a transformer 530, which can be an off-the-shelf transformer (e.g., 110V AC to 24V AC transformer), electrically connected to the socket 300, 300'.

The light fixture assembly 500 can also have a front cover 540 (e.g., trim ring) with an opening 542 that allow light generated by the LED 230 to pass therethrough. The front cover 540 can also have one or more locking members 542 that can couple to the corresponding front cover retaining mechanism 330 of the socket 300. In the illustrated embodiment, the locking members 542 can be protrusions that can releasably engage the slot 331 of the front cover retaining mechanism to attach the front cover 540 to the socket 300. In another embodiment, the front cover 540 can couple to the light fixture assembly 500 in other suitable ways (e.g., press-fit connection, threaded connection).

The light fixture assembly 500 can be used to provide a recessed lighting arrangement in a home or business, where the socket 300 can be on one side of the mounting surface (e.g., wall) and the mounting plate 510, housing 520 and transformer 530 can be out of sight on an opposite side of the mounting surface. Accordingly, a user can readily install and replace the LED light assembly 200, 200' and cover the socket 300, 300' with the front cover 540. In a preferred embodiment, the front cover 540 couples to the socket 300 so that no portion of the LED assembly 200, 200' is exposed, which provides an aesthetically pleasing arrangement.

Of course, the foregoing description is that of certain features, aspects and advantages of the present invention, to which various changes and modifications can be made without departing from the spirit and scope of the present invention. Moreover, the LED assembly need not feature all of the objects, advantages, features and aspects discussed above.

Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed reciprocating mechanism for a reel assembly.

What is claimed is:

1. An LED light module removably coupleable to a thermally-conductive member, comprising:

an LED lighting element;

one or more resilient members configured to flex when coupling the LED light module to a socket to maintain at least a portion of the LED light module in resilient contact with a thermally conductive surface of the socket or thermally-conductive member to thereby thermally couple at least a portion of the LED light module to the thermally conductive surface; and a plurality of electrical contact members electrically connected to the LED lighting element, at least one of the electrical contact members configured to releasably contact an electrical contact of the socket when the LED light module is coupled to the socket irrespective of the rotational orientation of the LED light module during coupling with the socket.

2. The removable LED light module of claim 1, further comprising a printed circuit board electrically coupled to the LED lighting element and configured to control the operation of the LED lighting element, the printed circuit board comprising said electrical contact members.

3. The removable LED light module of claim 1, wherein the electrical contact members are electrical contact strips or pads.

4. The removable LED light module of claim 1, wherein the electrical contact members are gold plated.

5. The removable LED light module of claim 1, wherein the one or more resilient members have a generally wishbone shape, each of the electrical contact members accessible through an opening between adjacent resilient members.

6. The removable LED light module of claim 1, wherein flexion of the one or more resilient members generates a compression force configured to maintain one or more surfaces of the LED light module in resilient contact with the thermally conductive surface.

7. The removable LED light module of claim 1, further comprising a wattage adjust control switch actuatable to adjust a wattage of the LED light module.

8. The removable LED light module of claim 1, further comprising an optic movable relative to a housing of the LED light module when the LED light module is coupled to the socket.

9. The removable LED light module of claim 8, wherein the LED lighting element is configured to move into a focal point of the optic when the LED light module is coupled to the socket and to move out of the focal point when the LED light module is disengaged from the socket.

10. The removable LED light module of claim 1, wherein the one or more resilient members are made of metal.

11. An LED light module removably coupleable to a light fixture assembly, comprising:

an LED lighting element;

one or more resilient members movable from a first position to a second position when the LED light module is coupled to a socket of the light fixture assembly to generate a compression force to thereby establish a resilient thermal connection between the LED light module and a surface or the light fixture assembly or socket of the light fixture assembly; and one or more electrical contact members electrically connected to the LED lighting element, at least one of the one or more electrical contact members configured to releasably contact an electrical contact on the socket of the light fixture assembly when the LED light module is coupled to the socket irrespective of the orientation of the LED light module during coupling with the socket.

12. The removable LED light module of claim 11, wherein the one or more electrical contact members are gold plated.

13. The removable LED light module of claim 11, further comprising a wattage adjust control switch actuatable to adjust wattage of the LED light module.

14. The removable LED light module of claim 11, further comprising a printed circuit board electrically connected to the LED lighting element, the printed circuit board comprising the one or more electrical contact members.

15. The removable LED light module of claim 11, wherein the one or more resilient members are made of metal.

16. A light fixture assembly, comprising:

a thermally-conductive housing;

an LED light module removably coupleable to the thermally-conductive housing, comprising:

an LED lighting element;

one or more resilient members movable between a first position and a second position when the LED light module is coupled to the thermally-conductive housing to resiliently maintain one or more surfaces of the LED light module in resilient contact with one or more surfaces of the thermally conductive housing to thereby establish a thermal connection between the LED light module and the thermally conductive housing; and a plurality of electrical contact members electrically connected to the LED lighting element and configured to releasably contact an electrical contact on the housing when the LED light module is coupled to the thermally conductive housing irrespective of the orientation of the LED light module during coupling with the thermally-conductive housing.

17. The light fixture assembly of claim 16, wherein the thermally-conductive housing comprises a socket configured to releasably couple to the LED light module, said socket comprising the electrical contact configured to releasably contact the electrical contact members of the LED light module, the socket dimensioned to cause the resilient members to compress when the LED light module is coupled to the socket.

18. The light fixture assembly of claim 17, wherein the socket is removably coupled to the thermally-conductive housing.

19. The light fixture assembly of claim 16, wherein the resilient members are made of metal.

20. The light fixture assembly of claim 16, wherein the electrical contact members of the LED light module are gold plated.

21. The light fixture assembly of claim 16, wherein the LED light module is releasably coupled to the thermally-conductive housing via the interaction of one or more protrusions on the LED light module and one or more slots in a socket of the thermally-conductive housing.

22. The light fixture assembly of claim 16, further comprising a wattage adjust control switch actuatable to adjust a wattage of the LED light module.

* * * * *

UNITED STATES PATENT AND TRADEMARK OFFICE

CERTIFICATE OF CORRECTION

PATENT NO. : 8,152,336 B2
APPLICATION NO. : 12/409409
DATED : April 10, 2012
INVENTOR(S) : Clayton Alexander and Brandon S. Mundell It is certified that error appears in the above-identified patent and that said Letters Patent is hereby corrected as shown below:

At column 7, line 3, please delete "CoolPoly®." and insert --CoolPoly®.--, therefor.

In claim 11 at column 14, line 11, please delete "surface or" and insert --surface of--, therefor.

Signed and Sealed this
Twenty-eighth Day of August, 2012

David J. Kappos

David J. Kappos
*Director of the United States Patent and Trademark Office*